US009714789B2

(12) United States Patent
Howard

(10) Patent No.: US 9,714,789 B2
(45) Date of Patent: Jul. 25, 2017

(54) AIR SEPARATION REFRIGERATION SUPPLY METHOD

(75) Inventor: Henry Edward Howard, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 2677 days.

(21) Appl. No.: 12/207,757

(22) Filed: Sep. 10, 2008

(65) Prior Publication Data

US 2010/0058805 A1 Mar. 11, 2010

(51) Int. Cl.

| | |
|---|---|
| ***F25J 3/04*** | (2006.01) |
| ***F25J 1/02*** | (2006.01) |
| ***F25J 1/00*** | (2006.01) |

(52) U.S. Cl.

CPC ..... *F25J 1/0234* (2013.01); *F25J 1/004* (2013.01); *F25J 1/0015* (2013.01); *F25J 1/0037* (2013.01); *F25J 1/0202* (2013.01); *F25J 3/0409* (2013.01); *F25J 3/04224* (2013.01); *F25J 3/04254* (2013.01); *F25J 3/04296* (2013.01); *F25J 3/04357* (2013.01); *F25J 3/04393* (2013.01); *F25J 3/04412* (2013.01); *F25J 3/04963* (2013.01); *F25J 2210/42* (2013.01); *F25J 2270/06* (2013.01)

(58) Field of Classification Search

USPC ..... 62/643, 902, 905, 912, 913, 939, 940, 62/617, 630, 631

See application file for complete search history.

(56) References Cited

U.S. PATENT DOCUMENTS

| | | | | |
|---|---|---|---|---|
| 4,099,945 | A | 7/1978 | Skolaude | |
| 5,139,547 | A * | 8/1992 | Agrawal et al. | 62/616 |
| 5,515,688 | A * | 5/1996 | Rieth | 62/646 |
| 5,579,655 | A * | 12/1996 | Grenier | 62/607 |
| 5,638,698 | A * | 6/1997 | Knight et al. | 62/632 |
| 5,638,699 | A * | 6/1997 | Yamamoto et al. | 62/643 |
| 5,758,515 | A | 6/1998 | Howard | |
| 5,802,874 | A * | 9/1998 | Voit | 62/650 |
| 5,901,580 | A * | 5/1999 | Darredeau et al. | 62/656 |
| 6,128,921 | A | 10/2000 | Guillard et al. | |
| 6,155,078 | A * | 12/2000 | Miyashita et al. | 62/643 |
| 6,257,020 | B1 * | 7/2001 | Tranier | 62/646 |
| 6,260,380 | B1 * | 7/2001 | Arman et al. | 62/646 |
| 6,539,748 | B2 * | 4/2003 | Prentice et al. | 62/654 |
| 6,581,411 | B2 | 6/2003 | Massimo et al. | |
| 6,666,048 | B1 | 12/2003 | Brugerolle et al. | |

(Continued)

FOREIGN PATENT DOCUMENTS

| | | | |
|---|---|---|---|
| CN | 101033910 | A | 9/2007 |
| EP | 1031804 | A1 * | 8/2000 |

(Continued)

*Primary Examiner* — Devon Russell

(74) *Attorney, Agent, or Firm* — Robert J. Hampsch; David M. Rosenblum

(57) ABSTRACT

A method of supplying refrigeration to air separation plants within an air separation plant facility in which a refrigerant stream is produced at cryogenic temperature within a centralized refrigeration system. Streams of the refrigerant at the cryogenic temperature are introduced into the air separation plants such that all or a part of the refrigeration requirements of the air separation plants are supplied by the streams of the refrigerant.

3 Claims, 2 Drawing Sheets

(56) References Cited

U.S. PATENT DOCUMENTS

| | | | | |
|---|---|---|---|---|
| 6,945,076 | B1 | 9/2005 | Garnier et al. | |
| 7,143,606 | B2 * | 12/2006 | Tranier | 62/611 |
| 2004/0261453 | A1 * | 12/2004 | Guillard et al. | 62/643 |
| 2007/0101763 | A1 | 5/2007 | Garnier et al. | |
| 2008/0000266 | A1 * | 1/2008 | Dee et al. | 62/643 |

FOREIGN PATENT DOCUMENTS

| | | | |
|---|---|---|---|
| EP | 1160528 | A2 * | 12/2001 |
| EP | 1544559 | A1 | 6/2005 |

* cited by examiner

AIR SEPARATION REFRIGERATION SUPPLY METHOD

FIELD OF THE INVENTION

The present invention relates to a method of supplying refrigeration to air separation plants within an air separation plant facility in which a refrigerant is produced at cryogenic temperature within a refrigeration system and streams of the refrigerant while at the cryogenic temperature are introduced into the air separation plants so that all or part of the refrigeration requirements for the air separation plants are supplied by the streams of the refrigerant.

BACKGROUND OF THE INVENTION

In many energy related projects such as in the gasification of coal very large quantities of oxygen are required. In some instances, upwards 10,000 to 15,000 metric tons per day of oxygen are required. At this scale, cryogenic air distillation is the preferred method of oxygen production.

In cryogenic air distillation, air is compressed and then purified of higher boiling contaminants such as carbon dioxide, moisture and hydrocarbons. The resulting compressed and purified feed stream can be cooled within a main heat exchanger to a temperature suitable for its rectification and then introduced into a distillation column unit having a higher pressure column and a lower pressure column. The higher pressure column can be thermally linked to the lower pressure column by a condenser-reboiler that can be positioned near the base of the lower pressure column.

The feed is distilled within the higher pressure column to produce a nitrogen-rich vapor overhead and a crude liquid oxygen bottoms. The nitrogen-rich vapor overhead can be condensed within a condenser-reboiler against boiling oxygen-rich liquid collected in the base of the lower pressure column. The resulting nitrogen-rich liquid is used to reflux both the higher pressure column and the lower pressure column. The crude-liquid oxygen bottoms is introduced into the lower pressure column for further refinement. Oxygen and nitrogen product streams composed of a second nitrogen-rich vapor overhead and further oxygen-enriched liquid bottoms are extracted and can be introduced into the main heat exchanger and fully warmed in order to cool the incoming feed. In an energy related application, a liquid oxygen containing stream can be withdrawn from the lower pressure column and pumped to produce a pressurized liquid stream. The pressurized liquid stream can then be vaporized within the main heat exchanger to produce the oxygen product at pressure.

In most cryogenic rectification systems, refrigeration must be supplied in order to offset ambient heat leakage, to facilitate heat exchanger operation and to produce liquefied products. In cryogenic air distillation, the feed air is compressed in a main air compressor and then purified. Part of the air can be further compressed, partially cooled and then expanded within a turboexpander to produce a stream which can be introduced at least in part into either the higher or lower pressure columns thereby imparting refrigeration into the plant. In instances where a product fraction is desired at substantial pressure, for example an oxygen product, a further part of the feed air may be further compressed and then fully cooled and liquefied within the main heat exchanger to vaporize the pumped liquid stream. The resulting liquid stream can be expanded within a liquid expander to generate a portion of the refrigeration. In other types of plants, a nitrogen containing stream can be partially warmed and then expanded to produce refrigeration.

As plant capacity increases, a need arises to develop air separation facilities which employ multiple (often duplicate) air separation trains. This process duplication enables more cost effective construction and coldbox shipment. Each of such plants will typically employ at least one process gas turbo-expansion in order to generate the necessary refrigeration. Radial inflow turbines are typically employed in cryogenic air separation. In such turbines the diameter of such expander wheels grow in proportion to the volumetric rate of exhaust gas. This results in a costly turbo-expander (which must be purchased for each train). In addition, the turbo-expansion is often constrained to operate at modest expansion ratio and pressure. As a consequence, the thermodynamic efficiency of refrigeration is not as high as that possible given state of the art expansion ratios.

The refrigeration issues mentioned above (with respect to conventional designs) combine to measurably increase the cost to produce oxygen and nitrogen. The subject invention addresses these problems by integrating the refrigeration systems and preferably employing high efficiency refrigeration/liquefaction features in a central refrigeration source.

SUMMARY OF THE INVENTION

The present invention provides a method of supplying refrigeration to air separation plants within an air separation plant facility. In accordance with the method, a refrigerant is produced at a cryogenic temperature within a refrigeration system. Streams of the refrigerant while at the cryogenic temperature are introduced into the air separation plants such that all or a part of the refrigeration requirements of the air separation plants are supplied by the streams of the refrigerant. As used herein and in the claims, the term, "cryogenic temperature" means a temperature that is below a temperature of about 200 K. It is to be noted that preferably, the cryogenic temperature should be below 150 K.

The refrigeration system can be a liquefier that produces the refrigerant at cryogenic temperatures by liquefying the refrigerant.

The refrigeration system can be operated on an intermittent basis such that liquid production of the air separation plants may be increased during operation of the refrigeration system.

The air can be separated within the air separation plants to produce products including a nitrogen-rich vapor. A nitrogen-rich vapor stream can be withdrawn from at least one of the air separation plants and liquefied within the refrigeration system to produce the refrigerant at the cryogenic temperature as a nitrogen-rich liquid. The streams of the refrigerant are introduced into the air separation plants by introducing nitrogen-rich liquid streams of the nitrogen liquid into the air separation plants. In this regard, the nitrogen-rich vapor stream can be liquefied in the refrigeration system by compressing and cooling a portion of the nitrogen-rich vapor contained within the nitrogen-rich vapor stream and generating refrigeration for the cooling, at least in part, by expanding another portion of the nitrogen-rich vapor within a turbo expander. Further, the air can be separated within the at least first of the air separation plants within an air separation unit comprising a higher pressure column and a lower pressure column. The nitrogen-rich vapor is produced as a column overhead of the lower pressure column and the nitrogen-rich vapor stream is fully warmed within a main heat exchanger of the at least first of the air separation plants. At least one of the nitrogen-rich liquid streams is introduced into the at least first of the air separation plants as reflux to the higher pressure column.

An oxygen-rich liquid stream can be pumped to produce a pumped liquid oxygen stream. At least part of the pumped liquid oxygen stream is vaporized or pseudovaporized within the main heat exchanger through indirect heat exchange with a compressed air stream and the compressed air stream after the indirect heat exchange is introduced into a liquid expander and is then introduced into at least one of the higher pressure column and the lower pressure column, thereby to impart part of the refrigeration requirements of the at least first of the air separation plants.

The compressed air stream can be a first compressed air stream. A second compressed air stream can be partly cooled within the main heat exchanger and expanded to produce an exhaust stream. The exhaust stream is introduced into the higher pressure column to impart a further part of the refrigeration requirement of the at least first of the air separation plants. The at least one of the nitrogen-rich liquid streams is introduced into the at least first of the air separation plants to increase liquid production within at least first of the air separation plants.

BRIEF DESCRIPTION OF THE DRAWING

While the specification concludes with claims distinctly pointing out the subject matter that Applicant regards as his invention, it is believed that the invention will be better understood when taken in connection with the accompanying drawings in which:

DETAILED DESCRIPTION

Figure 1:
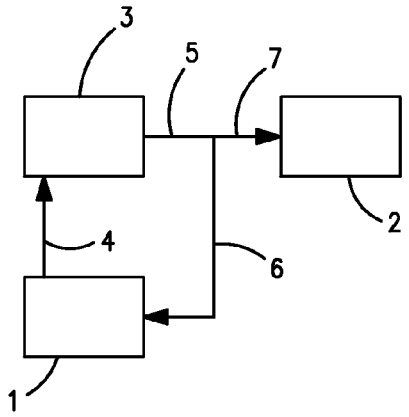
FIG. 1 is a schematic illustration of an air separation facility for carrying out a method in accordance with the present invention.

With reference to FIG. 1, an air separation facility is illustrated having air separation plants 1 and 2 and a central refrigeration system 3. In the particular installation, a nitrogen-rich stream 4 is used as the working fluid and is liquefied within central refrigeration system 3 to produce a refrigerant stream 5 at a cryogenic temperature. Streams 6 and 7 of the refrigerant stream 5 are fed back to the air separation plants 1 and 2 while at the cryogenic temperature to supply all or part of their refrigeration requirements. In the specific embodiment discussed herein, the streams 6 and 7 are nitrogen-rich liquid streams produced by liquefaction of a nitrogen-rich vapor stream. As such, refrigeration system 3 is a liquefier in the following discussion. It is to be noted that the present invention is not limited to such embodiments and other types of refrigeration systems are possible including closed-loop refrigeration system having a refrigerant medium that is capable of being produced at cryogenic temperature.

Figure 2:
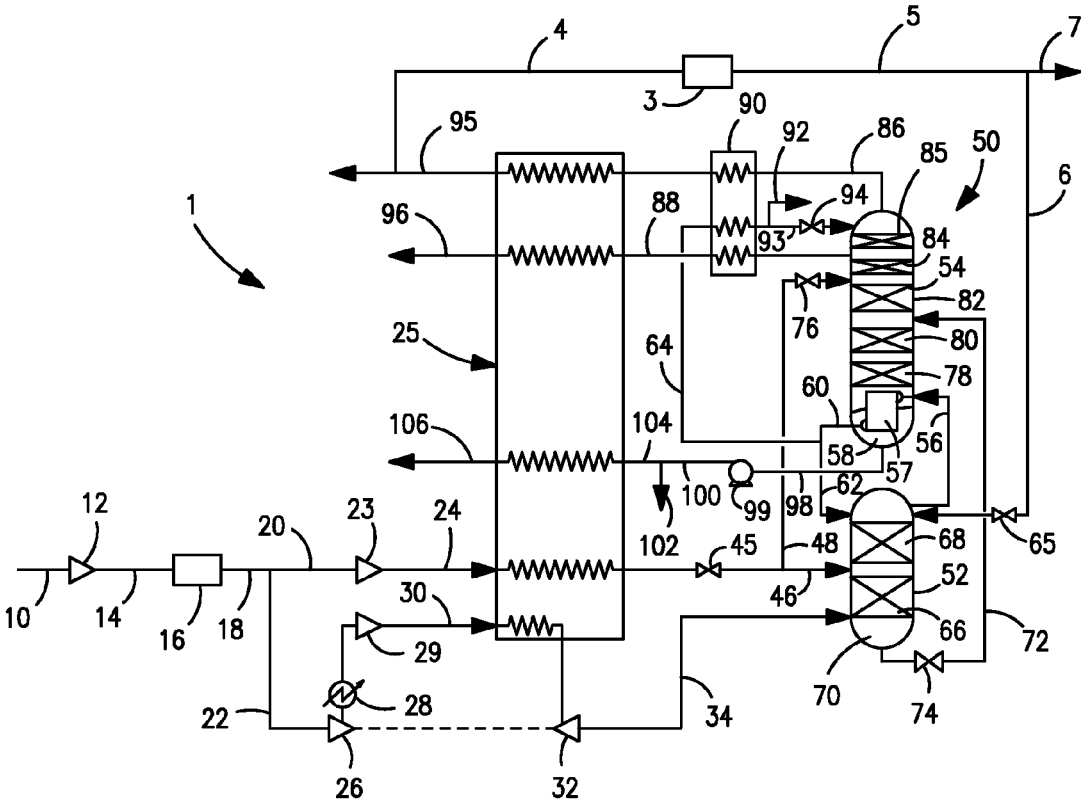
FIG. 2 is a schematic illustration of an air separation plant used within the facility of FIG. 1

With reference to FIG. 2, air separation plant 1 is illustrated. An air feed stream 10 is introduced into an air separation plant 1 to separate nitrogen from oxygen. Air feed stream 10 is compressed within a first compressor 12 to a pressure that can be between about 5 bara and about 15 bara. Compressor 12 may be an intercooled, integral gear compressor with condensate removal that is not shown.

After compression, the resultant compressed feed stream 14 is introduced into a prepurification unit 16. Prepurification unit 16 as well known in the art typically contains beds of alumina and/or molecular sieve operating in accordance with a temperature and/or pressure swing adsorption cycle in which moisture and other higher boiling impurities are adsorbed. As known in the art, such higher boiling impurities are typically, carbon dioxide, water vapor and hydrocarbons. While one bed is operating, another bed is regenerated. Other process could be used such as direct contact water cooling, refrigeration based chilling, direct contact with chilled water and phase separation.

The resultant compressed and purified feed stream 18 is then divided into a stream 20 and a stream 22. Typically, stream 20 is between about 25 percent and about 35 percent of the compressed and purified feed stream 18 and as illustrated, the remainder is stream 22.

Stream 20 is then further compressed within a compressor 23 which again may comprise intercooled, integral gear compressor. The second compressor 23 compresses the stream 20 to a pressure that can be compressed between about 25 bar(a) and about 70 bar(a) to produce a first compressed stream 24. The first compressed stream 24 is thereafter introduced into a first main heat exchanger 25 where it is cooled at the cold end of first main heat exchanger 25.

Stream 22 is further compressed by a turbine loaded booster compressor 26. After removal of the heat of compression by preferably, an after cooler 28, such stream is yet further compressed by a second booster compressor 29 to a pressure that can be in the range from between about 20 bar(a) to about 60 bar(a) to produce a second compressed stream 30. Second compressed stream 30 is then introduced into first main heat exchanger 25 in which it is partially cooled to a temperature in a range of between about 160 and about 220 Kelvin and is subsequently introduced into a turboexpander 32 to produce an exhaust stream 34 that is introduced into the air separation unit 50. As can be appreciated, the compression of stream 22 could take place in a single compression machine. As illustrated, turboexpander 32 is linked with first booster compressor 26, either directly or by appropriate gearing. However, it is also possible that turboexpander 32 be connected to a generator to produce electricity that could be used on-site or routed to the grid.

After the first compressed stream 24 has been cooled within main heat exchanger 25, it is expanded in an expansion valve 45 into a liquid and divided into liquid streams 46 and 48 for eventual introduction into the distillation column unit 50. Expansion valve 45 could be replaced by a liquid expander to generate part of the refrigeration.

The aforementioned components of the feed stream 10, oxygen and nitrogen, are separated within a distillation column unit 50 that consists of a higher pressure column 52 and a lower pressure column 54. It is understood that if argon were a necessary product, an argon column could be incorporated into the distillation column unit 50. Higher pressure column 52 operates at a higher pressure than lower pressure column 54. In this regard, lower pressure column 54 typically operates at between about 1.1 to about 1.5 bar(a).

The higher pressure column 52 and the lower pressure column 54 are in a heat transfer relationship such that a nitrogen-rich vapor column overhead extracted from the top of higher pressure column 52 as a stream 56 is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

With respect to reflux of higher pressure column 52., in addition to stream 62, the stream 6 of the refrigerant is introduced into higher pressure column 52 after having been valve expanded by a valve 65 to a suitable pressure.

Exhaust stream 34 is introduced into the higher pressure column 52 along with the liquid stream 46 for rectification by contacting an ascending vapor phase of such mixture within mass transfer contacting elements 66 and 68 with a descending liquid phase that is initiated by reflux stream 62. This produces a crude liquid oxygen column bottoms 70 and the nitrogen-rich column overhead that has been previously discussed. A stream 72 of the crude liquid oxygen column bottoms is expanded in an expansion valve 74 to the pressure of the lower pressure column 54 and introduced into such column for further refinement. Second liquid stream 48 is passed through an expansion valve 76, expanded to the pressure of lower pressure column 54 and then introduced into lower pressure column 54.

Lower pressure column 54 is provided with mass transfer contacting elements 78, 80, 82, 84 and 85 that can be trays or structured packing or random packing or other known elements in the art. As stated previously, the separation produces an oxygen-rich liquid column bottoms 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90. Subcooling unit 90 subcools reflux stream 64. Part of reflux stream 64, as a stream 92, may optionally be taken as a liquid product and a remaining part 93 may be introduced into lower pressure column 54 after having been reduced in pressure across an expansion valve 94.

After passage through subcooling unit 90, nitrogen product stream 86 and waste stream 88 are fully warmed within first main heat exchanger 25 to produce a warmed nitrogen product stream 95 and a warmed waste stream 95. Warmed waste stream 96 may be used to regenerate the adsorbents within prepurification unit 16. Part of the nitrogen product stream 95 is taken as stream 4 for liquefaction within central liquefier 3. In addition, an oxygen-rich liquid stream 98 is extracted from the bottom of the lower pressure column 54 that consists of the oxygen-rich liquid column bottoms 58. Oxygen-rich liquid stream 98 can be pumped by a pump 99 to form a pressurized oxygen containing stream 100. Part of the pressurized liquid oxygen stream 100 can optionally be taken as a liquid oxygen product stream 102. The remainder 104 can be fully warmed in first main heat exchanger 25 and vaporized to produce an oxygen product stream 106 at pressure.

The stream 6 of the refrigerant will increase the production of liquid products, for example oxygen-rich liquid stream 102. Air separation plant 2 could be of the same design as air separation plant 1 and the stream 7 of the refrigerant could be introduced into such plant in the same manner as stream 6 of the refrigerant. Additionally, part of the nitrogen product stream of such air separation plant 2 could also be feed to the central refrigeration system 3. In such case, plant refrigeration would be supplied by turboexpander 32 stream 24 within a liquid expander (in lieu of expansion valve 45) and introduction of the stream 6 of the refrigerant into higher pressure column 52. As can be appreciated, central refrigeration system 3 could be operated on an intermittent basis when it was desired to produce more liquid products. Another possibility might be that air separation plant 2 is designed without the turbine loaded booster arrangement of turboexpander 32 and second booster compressor 29. In such case, stream 7 of the refrigerant would be supplying all of the refrigeration requirements of air separation plant 2. Assuming the expansion valve 45 were replaced by a liquid expander, then stream 7 of the refrigerant would be supplying only part of the plant refrigeration requirements. A further possibility is to introduce the stream 7 of the refrigerant into the main heat exchanger of the second air separation plant.

Figure 3:
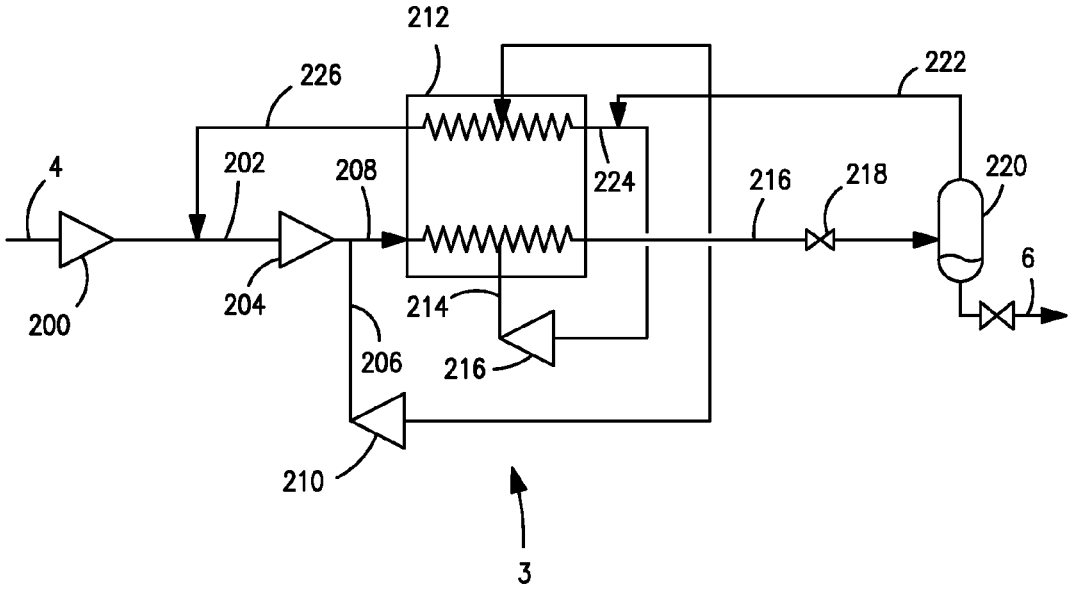
FIG. 3 is a schematic illustration of a liquefier used in connection with the facility illustrated in FIG. 1.

With reference to FIG. 3, central refrigeration system 3 is illustrated that is a nitrogen liquefier in which nitrogen-rich vapor contained within part 4 of the nitrogen product stream 95 is compressed and cooled to generate the liquid and refrigeration for the cooling is generated through turbo expansion of another part of the nitrogen-rich vapor. Although there are various design that are possible for such liquefiers, in the specific liquefier illustrated in FIG. 3, part 4 of the nitrogen product stream 95 is compressed in a feed gas compressor 200 to a pressure in the range of 4.8 to 6.2 bara. A recycled stream 226 is then merged with stream 5 to form combined recycle stream 202. Stream 202 is further compressed in a primary recycle compressor 204 to a pressure in the range of 35 to 55 bara. Compressors 200 and 204 may form part of the same machine, may employ multiple stages of intercooled compression and/or may be of centrifugal, axial or of positive displacement type.

After compression, combined recycle stream 202 is then subdivided into a warm expansion stream 206 and a remaining high pressure stream 208. Warm expansion stream 206 is turbo-expanded in turbine 210 to a pressure marginally above the pressure of stream combined recycle stream 202 and is then directed to an intermediary temperature location of a primary heat exchanger 212.

Remaining high pressure stream 208 is first cooled in primary heat exchanger 212 to an intermediate temperature, between the warm and cold end temperatures thereof, in the range of between about 150 K and about 180 K. Thereafter, a cold expansion stream 214 is extracted and expanded in turboexpander 216 to a pressure marginally above the pressure of combined recycle stream 202. This stream is then directed to the cold end of primary heat exchanger 212. The remaining fraction of stream 208, stream 216, is further cooled to a temperature below the critical temperature of nitrogen and preferably to a temperature marginally above the saturated vapor temperature of stream 6 of the refrigerant. Stream 216 exits primary heat exchanger 212 most likely in a sub-cooled, super-critical dense liquid like state. Stream 216 is then expanded in valve 218 or potentially a dense phase expander to an intermediary pressure and phase separated in vessel 220. The resulting vapor phase stream 222 is then combined with cold expansion stream 214, after expansion, to form combined stream 224. Combined stream 224 is warmed to ambient along with warm expansion stream 206 after expansion to form recycle stream 226 that is then recycled to the primary recycle compressor 204 as described. Alternatively stream 206, 214 and 222 could be directed to separate and distinct passages within exchanger 212. Such stream can then be combined as necessary.

Although the use of liquefied nitrogen as a transmission medium of refrigeration is preferred, there are other possibilities. For instance, a portion of the boosted air for air liquefaction could be combined after cooling with the cold end air streams which naturally exist in an air separation plant. Furthermore, it is possible to transfer the refrigeration to a secondary refrigerant/coolant such as a mixed gas refrigerant and then direct the same to the various air separation plants. If such other refrigerant streams were used, then they would be introduced into the various air separation plants in the main heat exchanger and recirculated back to the refrigeration system in closed recirculation loops. Alternatively, such refrigeration could be imparted to streams extracted from the main heat exchanger. The cooled stream could then be returned to the columns or the main heat exchanger.

The operation of a centralized refrigeration circuit can be integrated with the on-site liquid storage/tankage system. In particular, the liquid produced from the refrigeration system can be first sent to storage for later dispersal to plants as required. Alternatively, a liquid exchange type heat exchanger can be used to transfer the refrigeration medium into another medium. For instance, liquefied nitrogen can be vaporized against a condensing stream of pressurized oxygen. The liquefied oxygen can then be sent to storage or to the plants for sustaining refrigeration. Some of the liquid generated from a centralized refrigeration system can be directed to off-site use. If a liquefied fluid is sent to low pressure storage it will naturally be necessary to mechanically pump the fluid back into the various air separation plants.

It should be noted that an enclave can utilize multiple air separation plants of different types (they need not be duplicate processes). For instance, one plant can be designed to deliver a high pressure, high purity nitrogen stream while the other can be designed for only oxygen production. In both instances, a centralized refrigeration system can be used to supply refrigeration to both.

While the present invention has been described in reference to a preferred embodiment as will occur to those skilled in the art, numerous changes and additions and omissions can be made without departing from the spirit and the scope of the present invention as set forth in the appended claims.

I claim:

1. A method of supplying refrigeration to air separation plants located within an air separation plant facility, such method comprising:

producing a refrigerant at a cryogenic temperature within a refrigeration system; and introducing streams of the refrigerant, while at the cryogenic temperature into the air separation plants such that all or a part of the refrigeration requirements of the air separation plants are supplied by the streams of the refrigerant;

wherein air is separated within the air separation plants to produce products including a nitrogen-rich vapor and the nitrogen-rich vapor stream is withdrawn from at least one of the air separation plants;

wherein said nitrogen-rich vapor stream is liquefied within the refrigeration system to produce the refrigerant at the cryogenic temperature as a nitrogen-rich liquid and the streams of the refrigerant are introduced into the air separation plants by introducing nitrogen-rich liquid streams of said nitrogen-rich liquid into said separation plants;

wherein the air is separated within the at least first of the air separation plants within an air separation unit comprising a higher pressure column and a lower pressure column and the nitrogen-rich vapor is produced as a column overhead of the lower pressure column;

wherein the nitrogen-rich vapor stream is fully warmed within a main heat exchanger of the at least first of the air separation plants;

wherein at least one of the nitrogen-rich liquid streams is introduced into the at least first of the air separation plants as reflux to the higher pressure column;

wherein an oxygen-rich liquid stream is pumped to produce a pumped liquid oxygen stream and at least part of the pumped liquid oxygen stream is vaporized or pseudo vaporized within the main heat exchanger through indirect heat exchange with a compressed air stream;

wherein the compressed air stream after the indirect heat exchange is introduced into a liquid expander and introduced into at least one of the higher pressure column and the lower pressure column, thereby to impart part of the refrigeration requirements of the at least first of the air separation plants;

wherein the compressed air stream is a first compressed air stream;

wherein a second compressed air stream is partly cooled within the main heat exchanger and expanded to produce an exhaust stream;

wherein the exhaust stream is introduced into the higher pressure column to impart a further part of the refrigeration requirement of the at least first of the air separation plants; and wherein the at least one of the nitrogen-rich liquid streams is introduced into the at least first of the air separation plants to increase liquid production within at least first of the air separation plants.

2. The method of claim 1, wherein the refrigeration system is operated on an intermittent basis such that liquid production of the air separation plants is increased during operation of the refrigeration system.

3. The method of claim 1, wherein the nitrogen-rich vapor stream is liquefied in the refrigeration system by compressing and cooling a portion of the nitrogen-rich vapor contained within the nitrogen-rich vapor stream and refrigeration for the cooling is generated at least in part by expanding another portion of the nitrogen-rich vapor within a turbo expander.

* * * * *